US005676258A

United States Patent [19]

Leyden et al.

[11] Patent Number: 5,676,258

[45] Date of Patent: Oct. 14, 1997

[54] SECURITY SYSTEM FOR APERTURED GOODS

[75] Inventors: Roger J. Leyden, Willow Springs; Terrance Surma, Bloomingdale, both of Ill.

[73] Assignee: Se-Kure Controls, Inc., Franklin Park, Ill.

[21] Appl. No.: 519,072

[22] Filed: Aug. 24, 1995

[51] Int. Cl.[6] ..... A47F 5/00

[52] U.S. Cl. ..... 211/7; 70/14; 70/58; 211/59.1; 211/94; 248/553; 248/225.11; 248/221.11; 248/229.14

[58] Field of Search ..... 211/7, 4, 57.1, 211/59.1, 94; 70/14, 58; 248/551, 553, 225.11, 225.21, 222.14, 221.11, 229.13, 229.14, 229.15

[56] References Cited

U.S. PATENT DOCUMENTS

| | | | |
|---|---|---|---|
| 4,289,242 | 9/1981 | Kenyon | 211/59.1 X |
| 4,678,151 | 7/1987 | Radek | 211/59.1 X |
| 4,882,868 | 11/1989 | Fast | 211/59.1 X |
| 5,259,220 | 11/1993 | Fredrickson | 211/7 X |
| 5,275,027 | 1/1994 | Eklof et al. | 70/14 |
| 5,375,802 | 12/1994 | Branham | 248/221.11 |
| 5,407,170 | 4/1995 | Slivon et al. | 211/7 X |

*Primary Examiner*—Robert W. Gibson, Jr.
*Attorney, Agent, or Firm*—Wood, Phillips, VanSanten, Clark & Mortimer

[57] ABSTRACT

A display system for an article, which display system includes an elongate support member with structure for fixedly attaching the elongate support member to a base in a display position. The elongate support member has an entry end which can be directed through an aperture in an article to be displayed so as to allow the article to be displayed to be placed in a display state and slide guidingly lengthwise along the elongate support member. Structure is provided on at least one of the elongate support member and a base on which the elongate support member is fixedly attached in the display position for confining movement of an article to be displayed guidingly along the length of the elongate support member in one direction. A lock member is provided, with there being structure cooperating between the lock member and elongate support member for selectively a) maintaining the lock member in a first locked position wherein the lock member limits movement of an article to be displayed that is in a display state along the elongate support member oppositely to the one direction so that an article to be displayed cannot be separated from the elongate support member by movement in the one direction relative to the elongate support member and b) allowing the lock member to be placed in a second position wherein an article to be displayed can be selectively placed in the display state and separated from the elongate support member.

20 Claims, 4 Drawing Sheets

SECURITY SYSTEM FOR APERTURED GOODS

BACKGROUND OF THE INVENTION

1. Field of the Invention

This invention relates to security systems as used to prevent unauthorized removal of consumer goods and, more particularly, to a system using an elongate member that can be directed through an aperture in the goods to be secured.

2. Background Art

Those involved in the distribution of consumer goods are constantly seeking ways to prevent unauthorized removal of goods from display areas. The expense of security systems and personnel used to limit losses due to theft is generally recovered by raising the price of the goods to the consumer. In today's highly competitive market, the successful retailer thus seeks security systems that are both economically practical and effective.

The assignee herein is the owner of numerous patents directed to security systems for different types of consumer articles. In U.S. Pat. No. 5,172,098, a sophisticated electronic security system is shown for discrete objects. This system has proven to be highly commercially successful.

However, the use of an electronic security system is not always feasible. Sometimes, the cost of the goods to be monitored does not justify the investment in such a system. For other types of goods, such as belts, the quantity of goods displayed is such that it would be impractical to monitor each item, as by the use of a sensor thereon.

Further, highly portable goods such as belts, which are small and lightweight, can be easily removed from a premise before the breach of security is detected, even when electronic systems are used. Many stores are set up with display stands for such goods in close proximity to an exit door. The thief is often able to remove the article, exit promptly from the store through the adjacent exit, and become lost in crowds as are common in a metropolitan area.

It is known to confine a quantity of discrete articles in bulk upon a display stand. However, when this type of system is used for relatively small, lightweight articles, the thief may be able to remove and make off with the entire quantity of articles, together with the display stand.

As a result of the above problems, many purveyors of small, discrete objects, such as hand tools in hardware stores, belts in apparel stores, rackets and the like in sporting goods stores, etc. choose to hang this type of good unsecured on a mounting wall. In many stores, pegboard is used in conjunction with a projecting arm to support a stack of such goods. For example, a number of tennis rackets are commonly seen in sporting goods stores supported from a cantilevered arm on a vertical wall. In spite of the risk associated with this type of display, many purveyors of these goods have chosen to assume this risk rather than contend with the above problems.

SUMMARY OF THE INVENTION

In one form of the invention, a display system is provided for an article, which display system includes an elongate support member with structure for fixedly attaching the elongate support member to a base in a display position. The elongate support member has an entry end which can be directed through an aperture in an article to be displayed so as to allow the article to be displayed to be placed in a display state and slide guidingly lengthwise along the elongate support member. Structure is provided on at least one of the elongate support member and a base on which the elongate support member is fixedly attached in the display position for confining movement of an article to be displayed guidingly along the length of the elongate support member in one direction. A lock member is provided, with there being structure cooperating between the lock member and elongate support member for selectively a) maintaining the lock member in a first locked position wherein the lock member limits movement of an article to be displayed that is in a display state along the elongate support member oppositely to the one direction so that an article to be displayed cannot be separated from the elongate support member by movement in the one direction relative to the elongate support member and b) allowing the lock member to be placed in a second position wherein an article to be displayed can be selectively placed in the display state and separated from the elongate support member.

In one form, the elongate support member is an elongate rod having a substantially uniform cross-sectional configuration taken transversely to the length thereof over substantially its entire length.

The invention further contemplates the combination of the above elements with an article having an aperture that is substantially fully surrounded, with the elongate support member extending through the aperture with the article in a display state.

In one form, the base is a vertical wall with a slot therein defining a wall portion with oppositely facing first and second surfaces and the structure for fixedly attaching the elongate support member is structure on the elongate support member that releasably captively embraces the first and second surfaces.

The structure for fixedly attaching the elongate support member may be a first plate with an offset that fits in the slot on the base and a second plate on the elongate support member, with there being structure for drawing the offset towards the second plate to captively hold the base wall portion between the offset and the second plate.

The first plate may be fixed to the elongate support member, with the second plate having an aperture therethrough to receive the elongate support member and allow the second plate to move guidingly along the length of the elongate support member.

In one form, with the elongate support member in the display position, the elongate support member projects in cantilever fashion from a base to which the elongate support member is fixedly attached. The entry end of the elongate support member is a free end, with the structure cooperating between the lock member and elongate support member maintaining the lock member at the free end of the elongate support member with the lock member in the first locked position.

In a preferred form, with the elongate support member extending through an apertured article, the lock member and aperture in the article are relatively configured so that the lock member cannot pass through the aperture in the article with the article in the display state.

In one form, the structure cooperating between the lock member and the elongate support member allows press fitting of the lock member into the first locked position at the free end of the elongate support member.

The structure cooperating between the lock member and elongate support member may allow selective release of the lock member from the first position to allow the lock member to be placed in the second position. A keyed lock or a combination lock can be used for this purpose.

The free end of the elongate support member may be tapered to be guided into an opening in the lock member. This facilitates guided movement of the lock member into its first locked position.

In another form of the invention, a display system is provided for an article, which display system includes an elongate support member having first and second ends and a substantially uniform cross section taken transversely to the length of the elongate support member between the first and second ends. Structure is provided for fixedly attaching the first end of the elongate support member to a base in a display position, wherein the elongate support member projects in cantilever fashion with the second end exposed. A lock member is provided, with there being structure cooperating between the lock member and elongate support member for releasably maintaining the lock member in a locked position at the second end of the elongate support member to prevent an article through which the elongate support member projects from sliding lengthwise of the elongate support member past the second end of the elongate support member to be separated therefrom.

The structure cooperating between the lock member and elongate support member may allow the lock member to be press fit into the locked position by relatively moving the lock member and elongate support member against each other in a line substantially parallel to the length of the elongate support member.

The invention further contemplates a method of displaying an article with an aperture therethrough, including the steps of providing an elongate support member with first and second ends, attaching the first end of the elongate support member to a base at a first location so that the elongate support member projects in cantilever fashion from the base, directing the second end of the elongate support member through the aperture in the article to place the article in the display state, providing a lock member, and attaching the lock member to the second end of the elongate support member for maintaining the lock member at the second end of the elongate support member to block movement of the article out of the display state past the second end of the elongate support member.

The method may further include the step of removing the lock member from the elongate support member to remove the article that is in the display state.

The method may further include the step of separating the first end of the elongate support member from the base and attaching the first end of the elongate support member to the base at a second location.

DETAILED DESCRIPTION OF THE DRAWINGS

Figure 2:
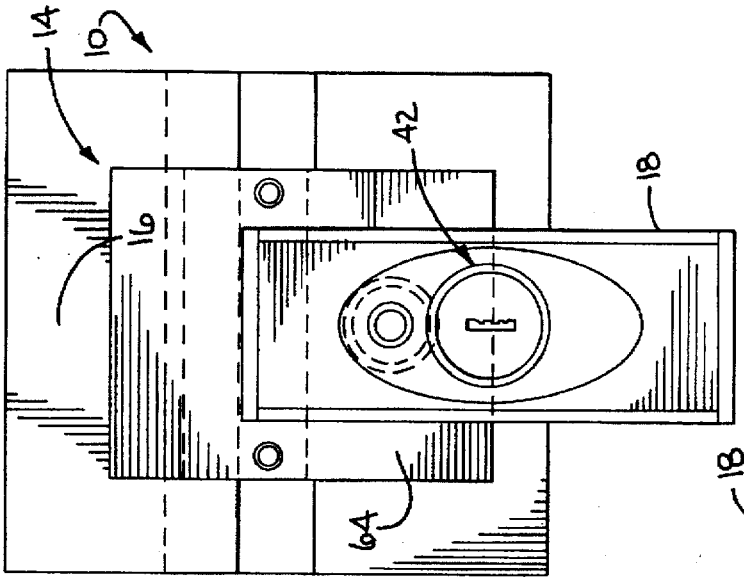
FIG. 2 is an enlarged, end elevation view of the display system in FIG. 1.

Referring initially to FIGS. 1–7, a preferred form of display system for an article, according to the present invention, is shown at 10. The display system 10 is made up of an elongate support member 12, which projects through an apertured article, such as any of those shown in FIGS. 8–11 and discussed hereinbelow, a means at 14 for fixedly attaching an end 15 of the elongate support member 12 to a base 16, and a removable lock member 18 attached to the opposite end 20 of the elongate support member 12 at a location remote from the base 16.

With the support member 12 attached to the base 16 in a display position, the elongate support member 12 projects in cantilever fashion from the base 16. By removing the lock member 18, the free end 20 of the elongate support member 12 is exposed to be directed through an apertured object to be displayed. The free end 20 is tapered to facilitate direction thereof through the object as well as to facilitate entry of the free end 20 into the lock member 18, as described below.

The support member 12 preferably has a uniform cross-sectional configuration taken transversely to its length. With this arrangement, an article to be displayed can be conveniently guided along the support member 12 between the base 16 and lock member 18.

Figure 8:
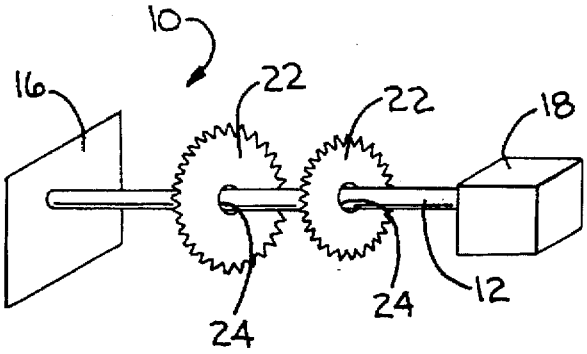
FIG. 8 is a reduced, schematic, perspective view of the inventive display system with circular saw blades displayed thereon.

In FIG. 8, circular saw blades 22, each with an aperture 24 therethrough, are shown in a display state on the inventive system 10. As many blades 22 as will fit between the base 16 and lock member 18 can be placed upon the support member 12 in the display state. Once the desired number of saw blades 22 is in place, the lock member 18 is attached to the free end 20 of the support member 12, as described below. The lock member 18 is configured so that the saw blades 22 cannot be directed from left to right in FIG. 8 past the lock member 18 to be separated from the system 10. Movement of the saw blades 22 to the left in FIG. 8 is confined by the base 16.

Figure 9:
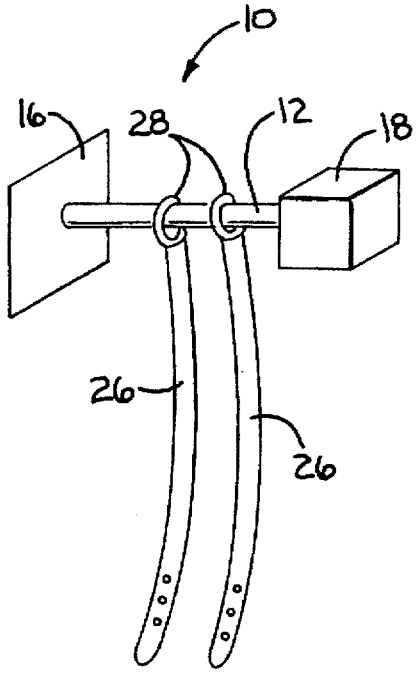
FIG. 9 is a view as in FIG. 8 with belts displayed thereon.

In FIG. 9, the system 10 is shown with belts 26 in a display state thereon. The support member 12 is directed through a buckle 28 on each belt 26.

Figure 10:
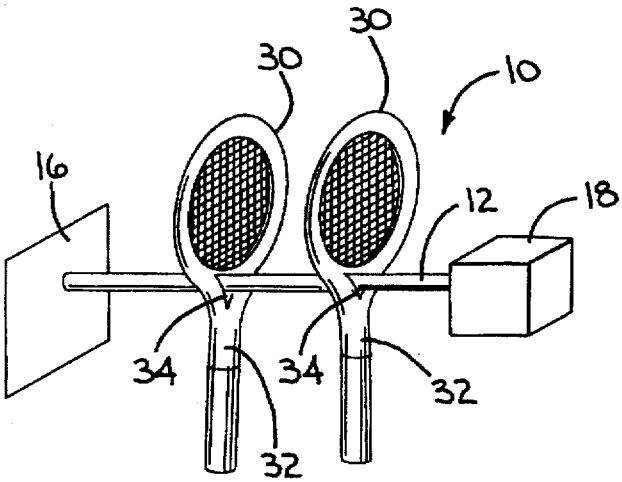
FIG. 10 is a view as in FIGS. 8 and 9 with tennis rackets displayed thereon.

In FIG. 10, the system 10 is shown with tennis rackets 30 displayed thereon. Each racket 30 has a frame 32 with an aperture 34 therethrough to receive the support member 12.

Figure 11:
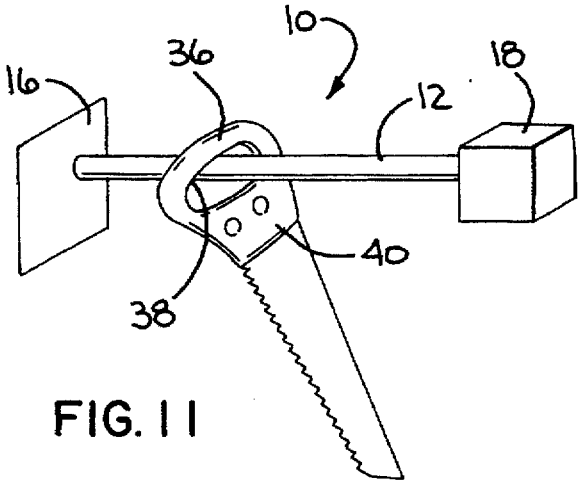
FIG. 11 is a view as in FIGS. 8–10 with a hand saw displayed thereon.

In FIG. 11, a hand saw 36 is shown displayed on the system 10 with the support member 12 extending through an opening 38 on a handle 40 on the saw 36.

Figure 1:
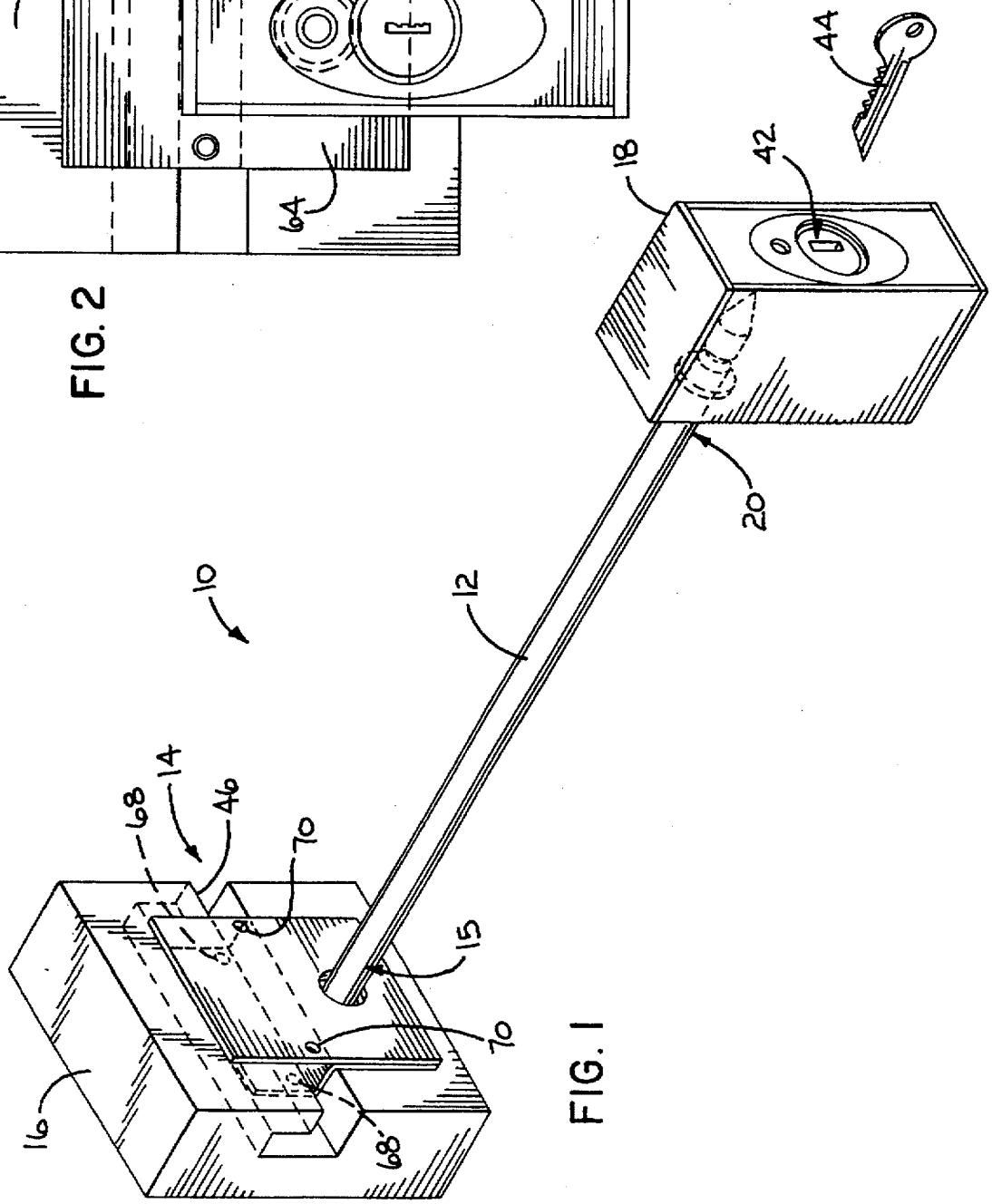
FIG. 1 is a perspective view of a display system according to the present invention including an elongate support member fixed to a base and a lock member partially assembled to the elongate support member.
Figure 3:
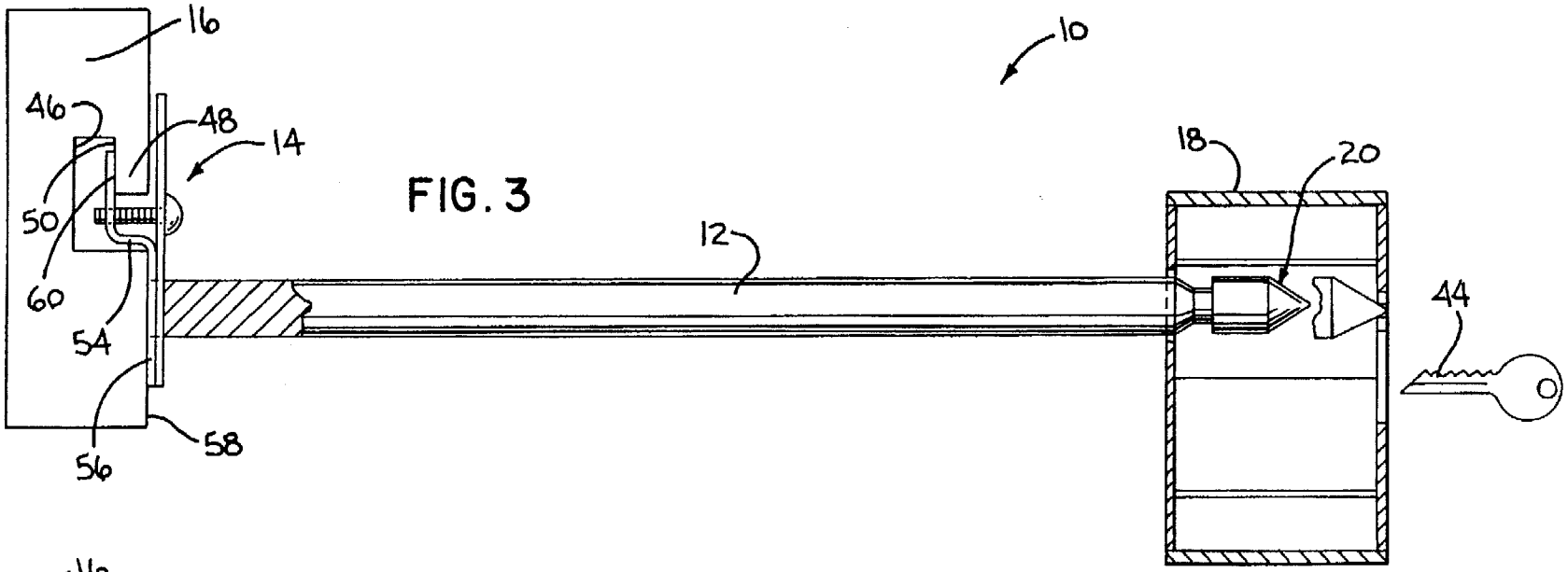
FIG. 3 is a side elevation view of the display system in FIG. 1 shown partially in cross section.
Figure 4:
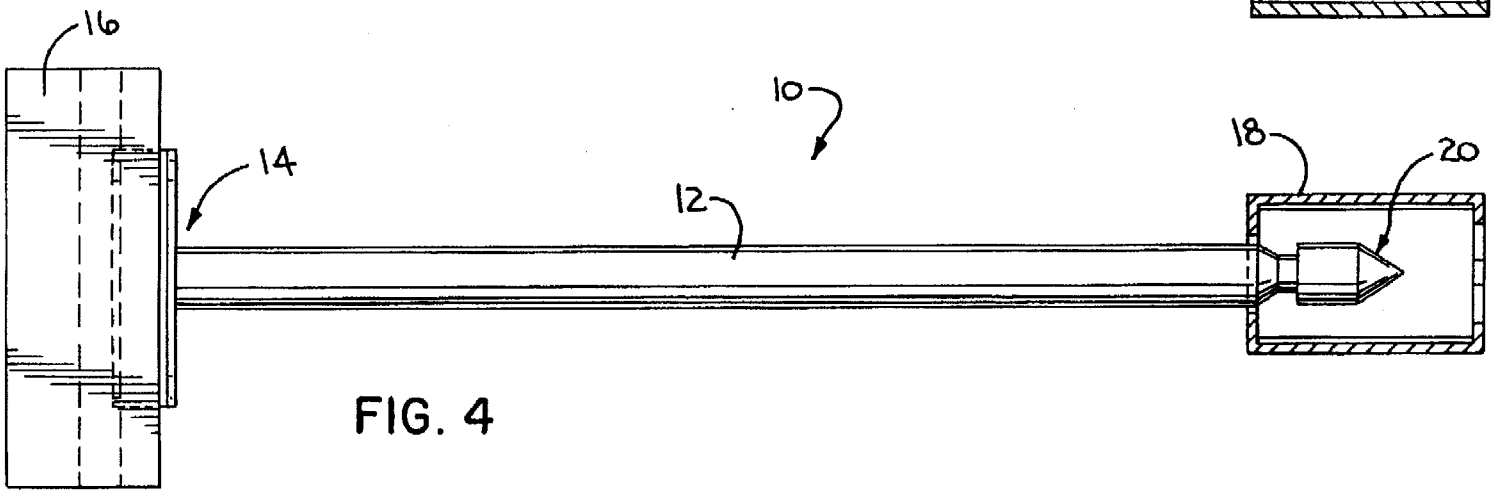
FIG. 4 is a plan view of the display system in FIGS. 1–3 shown partially in cross section.
Figure 5:
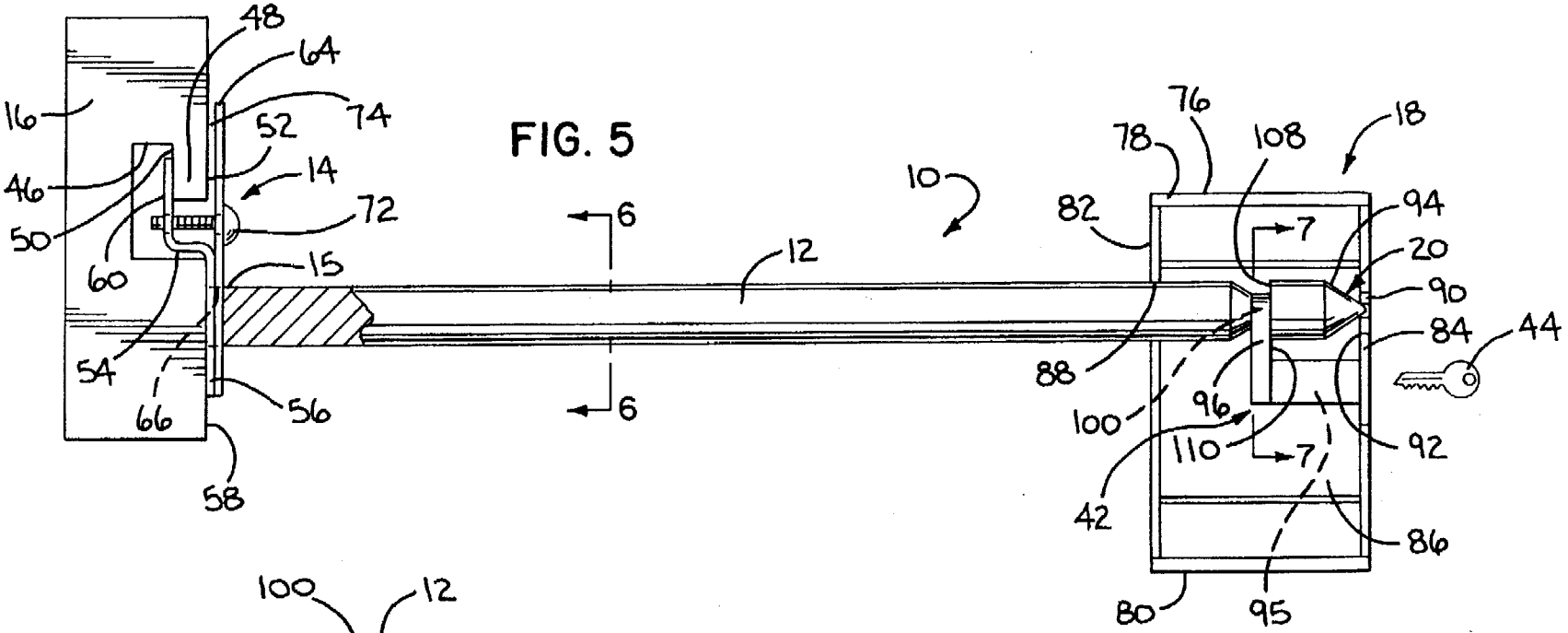
FIG. 5 is a view as in FIG. 3 with the lock member in a locked position on the elongate support member.

The invention contemplates that the lock member 18 be press fit into the locked state and removable therefrom as through the use of a keyed lock 42 (see FIGS. 1 and 5). The user of the system can simply mount the support member 12 to the base 16 as described below, direct the free end 20 of support member 12 through an aperture in an article to be displayed, slide the article along the support member 12 and then press fit the lock member 18 to the free end 20 of the support member 12 to secure the displayed articles against unauthorized removal from the system 10. The lock member 18 can be removed by using a key 44 to operate the lock 42.

The system 10, while useable in other environments, is particularly adaptable to use with a base 16 that is in the form of a slot wall, as shown in FIGS. 1 and 3–5. The slot wall 16 is of a conventional construction and has an L-shaped slot 46 defining a wall portion 48 with oppositely facing first and second flat surfaces 50, 52.

The means 14 includes a Z-shaped plate 54 with a first leg 56 that is abuttable to a forwardly facing surface 58 and an offset 60, which abuts the surface 50 on the wall portion 48 with the first leg 56 abutted to the wall surface 58. The plate 54 is fixed, as by welding, to the base end 15 of the support member 12.

The means 14 includes a second plate 64 having an aperture 66 therethrough to allow the plate 64 to slide lengthwise guidingly along the support member 12. The plate 64 can be directed from right to left in FIGS. 1 and 3–5 to facially abut the Z-shape plate 54. Threaded bores 68 in the offset 60 align with bores 70 in the second plate 64. Screws 72 are directed through the bores 70 and threaded into the bores 68 in the offset 60. By tightening the screws 72, the wall portion 48 is held captive between the plates 54, 64. While a slight gap 74 is shown between the plate 64 and the wall portion 48, the plate 64 could be reconfigured to flushly abut the surface 52. Even with the gap 74, a captive-type arrangement is formed which positively holds the plates 54, 64, and thus the support member 12, in a fixed position relative to the base 16.

This arrangement allows the screws 72 to be loosened and the support member 12 to be slid along the length of the slot 46 to select another desired location for the system 10. The screws 72 are then tightened at the desired location.

The lock member 18 has a homing 76 with opposed wall pairs 78, 80 and 82, 84 cooperatively bounding an internal space 86. The wall 82 has a through bore 88 to closely accept and allow passage therethrough of the support member 12. The wall 84 has a smaller diameter through bore 90 which is less than the diameter of the support member 12 and defines an annular shoulder 92 to seat a tapered portion 94 at the free end 20 of the support member 12, with the lock member 18 in the locked position on the support member 12.

Figure 7:
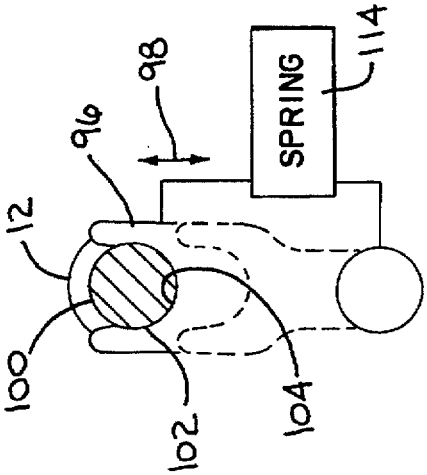
FIG. 7 is an enlarged, cross-sectional view of the display system taken along line 7—7 of FIG. 5 and showing a locking element in a locked position in solid line positions and in a release position in phantom lines.

The lock 42, as shown in FIGS. 1, 5 and 7, is mounted upon the wall 84 and releasably maintains the lock member 18 in the locked position of FIG. 5. More particularly, the lock 42 has a keyed tumbler 95 which manipulates a catch 96, selectively moving the catch 96 vertically in FIG. 5 and in the direction of the double-headed arrow 98 in FIG. 7 between the solid line position and phantom line position. In the solid line position, the catch 96 moves into a radial undercut 100 in the support member 12. With the catch 96 extending fully upwardly, a reduced diameter portion 102 of the support member 12 nests in a complementary seat 104 defined by the catch 96. An axially facing shoulder 108, defined by the undercut 100, simultaneously confronts an axially facing surface 110 on the catch 96 to prevent separation of the lock member 18 from the support member 12, i.e. by movement of the lock member 18 to the right in FIG. 5 relative to the support member 12.

Through the key 44, or through a combination-type actuator (not shown), the lock 42 can be operated to retract the catch 96 from the solid line position of FIG. 7 to the phantom line position. Once retracted, the catch 96 moves out of the path of the shoulder 108 and allows the lock member 18 to be fully withdrawn and separated from the support member 12.

In a preferred form, the catch 96 is biased by a spring 114 towards the solid line position in FIG. 7. By directing the free end 20 of the support member 12 through the aperture 88, the tapered portion 94 of the support member 12 progressively cams the catch 96, against the force of the spring 114, towards the phantom line position in FIG. 7. As the catch 96 moves axially into coincidence with the undercut 100, the catch 96 springs back to the solid line position and thereby maintains the lock member 18 in the locked position of FIG. 5. This facilitates setup of the system 10 by obviating the need to use the key to "set" the system. Release of the lock member 18 is effected through the key 44 in the manner previously described.

Figure 6:
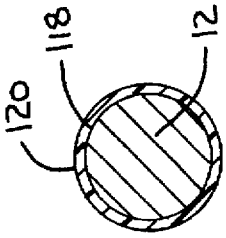
FIG. 6 is an enlarged, cross-sectional view of the elongate support member taken along line 6—6 of FIG. 5.

To protect the various articles that may be displayed, the outer surface 118 of the support member 12 may have a rubber coating 120 applied thereto, as shown in FIG. 6.

With the inventive system 10, the user can simply attach the support member 12 in cantilever fashion from a base 16, which could be the slot wall shown or another type of support. With the support member 12 assembled to the base 16, it could project either vertically or horizontally. Apertured articles to be displayed can be simply placed upon the support member whereupon the lock member 18 can be pressed into the locked position of FIG. 5 to secure the system 10. The lock element 18 can be conveniently removed by authorized personnel through the use of a key 44. The length and diameter of the support element 12 and dimension of the dock member 18 can be selected depending upon the nature and quantity of articles to be displayed.

The foregoing disclosure of specific embodiments is intended to be illustrative of the broad concepts comprehended by the invention.

We claim:

1. A display system for an article, said display system comprising:

an elongate support member for at least one article to be displayed;

means for fixedly attaching the elongate support member to a base in a display position, said elongate support member having an entry end which can be directed through an aperture in an article to be displayed so as to allow the article to be displayed to be placed in a display state and slide guidingly lengthwise along the elongate support member;

means on at least one of the elongate support member and a base on which the elongate support member is fixedly attached in the display position for confining movement of an article to be displayed guidingly along the length of the elongate support member in one direction;

a lock member; and means cooperating between the lock member and elongate support member for selectively a) maintaining the lock member in a first locked position wherein the lock member limits movement of an article to be displayed that is in a display state along the elongate support member oppositely to the one direction so that an article to be displayed cannot be separated from the elongate support member by movement in either direction relative to the elongate support member and b) allowing the lock member to be placed in a second position wherein an article to be displayed can be selectively placed in the display state and separated from the elongate support member, said lock member having a wall extending continuously around a fixed diameter bore through which the elongate support member extends with the lock member in the first locked position.

2. The display system according to claim 1 wherein the elongate support member comprises an elongate rod having a substantially uniform cross-sectional configuration taken transversely to the length of the elongate rod over substantially its entire length, said cooperating means comprising a catch on the lock member and a shoulder facing lengthwise of the elongate support member defined by an undercut in the elongate support member, said catch abutting to the shoulder with the lock member in the first locked position.

3. The display system according to claim 1 in combination with an article having an aperture that is substantially fully surrounded with the elongate support member extending through the aperture with the article in the display state.

4. The display system according to claim 1 in combination with a base wherein the base comprises a vertical wall with a slot therein defining a wall portion with oppositely facing first and second surfaces and the means for fixedly attaching the elongate support member comprises means on the elongate support member for releasably captively embracing the first and second surfaces.

5. A display system for an article, said display system comprising:

an elongate support member for at least one article to be displayed;

means for fixedly attaching the elongate support member to a base in a display position, said elongate support member having an entry end which can be directed through an aperture in an article to be displayed so as to allow the article to be displayed to be placed in a display state and slide guidingly lengthwise along the elongate support member;

means on at least one of the elongate support member and a base on which the elongate support member is fixedly attached in the display position for confining movement of an article to be displayed guidingly along the length of the elongate support member in one direction;

a lock member; and means cooperating between the lock member and elongate support member for selectively a) maintaining the lock member in a first locked position wherein the lock member limits movement of an article to be displayed that is in a display state along the elongate support member oppositely to the one direction so that an article to be displayed cannot be separated from the elongate support member by movement in either direction relative to the elongate support member and b) allowing the lock member to be placed in a second position wherein an article to be displayed can be selectively placed in the display state and separated from the elongate support member, wherein the base comprises a vertical wall with a slot therein defining a wall portion with oppositely facing first and second surfaces and the means for fixedly attaching the elongate support member comprises means on the elongate support member for releasably captively embracing the first and second surfaces, wherein the means for fixedly attaching the elongate support member comprises a first plate with an offset that fits in the slot on the vertical wall, a second plate on the elongate support member and means for drawing the offset towards the second plate to captively hold the wall portion between the offset and the second plate.

6. The display system according to claim 5 wherein the first plate is fixed to the elongate support member and the second plate has an aperture therethrough to receive the elongate support member and is slidable guidingly along the length of the elongate support member.

7. The display system according to claim 1 wherein with the elongate support member in the display position, the elongate support member projects in cantilever fashion from a base to which the elongate support member is fixedly attached, the entry end of the elongate support member is a free end and the means cooperating between the lock member and elongate support member comprises means for maintaining the lock member at the free end of the elongate support member with the lock member in the first locked position.

8. The display system according to claim 7 in combination with an article having an aperture that is substantially fully surrounded with the elongate support member extending through the aperture with the article in the display state and the lock member and aperture in the article are relatively configured so that the lock member cannot pass through the aperture in the article with the article in the display state.

9. The display system according to claim 8 wherein the means cooperating between the lock member and elongate support member comprises means for press fitting the lock member into the first locked position by directing the free end of the elongate support member into and through the lock member.

10. The display system according to claim 9 wherein the means cooperating between the lock member and elongate support member comprises means for selectively releasing the lock member from the first position to allow the lock member to be placed in the second position.

11. The display system according to claim 9 wherein the means for selectively releasing the lock member comprises a keyed lock.

12. A display system for an article, said display system comprising:

an elongate support member for at least one article to be displayed;

means for fixedly atttaching the elongate support member to a base in a display position, said elongate support member having an entry end which can be directed through an aperture in an article to be displayed so as to allow the article to be displayed to be placed in a display state and slide guidingly lengthwise along the elongate support member;

means on at least one of the elongate support member and a base on which the elongate support member is fixedly attached in the display position for confining movement of an article to be displayed guidingly along the length of the elongate support member in one direction;

a lock member; and means cooperating between the lock member and elongate support member for selectively a) maintaining the lock member in a first locked position wherein the lock member limits movement of an article to be displayed that is in a display state along the elongate support member oppositely to the one direction so that an article to be displayed cannot be separated from the elongate support member by movement in either direction relative to the elongate support member and b) allowing the lock member to be placed in a second position wherein an article to be displayed can be selectively placed in the display state and separated from the elongate support member, wherein with the elongate support member in the display position, the elongate support member projects in cantilever fashion from a base to which the elongate support member is fixedly attached, the entry end of the elongate support member is a free end and the means cooperating between the lock member and elongate support member comprises means for maintaining the lock member at the free end of the elongate support member with the lock member in the first locked position, wherein the free end of the elongate support member is tapered, the lock member has an opening therein to accept the free end of the elongate support member and the tapered free end of the elongate support member guides movement of the free end of the elongate support member into the lock member opening wherein the lock member is in the first locked position.

13. A display system for an article, said display system comprising:

an elongate support member having first and second ends and a substantially uniform cross section taken transversely to the length of the elongate support member between the first and second ends;

means for fixedly attaching the first end of the elongate support member to a base in a display position wherein the elongate support member projects in cantilever fashion with the second end exposed;

a lock member; and means cooperating between the lock member and elongate support member for releasably maintaining the lock member in a locked position at the second end of the elongate support member to prevent an article through which the elongate support member projects from sliding lengthwise of the elongate support member in a first direction past the second end of the elongate support member to be separated therefrom, said cooperating means comprising means for maintaining the lock member and elongate support member in a predetermined relative position with the lock member in the locked position so that the lock member is limited in movement by the cooperating means lengthwise relative to the elongate support member both in the first direction and oppositely to the first direction.

14. The display system according to claim 13 in combination with an article having an aperture therethrough that is substantially fully surrounded, said article being in a display state with the elongate support member extending through the aperture and the article residing between the first and second ends of the elongate support member.

15. The display system according to claim 13 wherein the means cooperating between the lock member and elongate support member comprises means for allowing the lock member to be press fit into and maintained in the locked position as an incident of relatively moving the lock member and elongate support member against each other in a line substantially parallel to the length of the elongate support member.

16. The display system according to claim 15 wherein the means cooperating between the lock member and elongate support member comprises keyed means for releasing the lock member from the locked position.

17. The display system according to claim 13 in combination with a base comprising a vertical wall with a slot therein defining a wall portion with first and second oppositely facing surfaces and the means for fixedly attaching the first end of the elongate support member comprises means on the elongate support member for captively holding the wall portion.

18. A method of displaying an article with an aperture therethrough, said method comprising the steps of:

providing an elongate support member with a first end and a second free end, a central axis that is substantially straight from the first end to the second free end, and a shoulder facing lengthwise of the elongate support member;

attaching the first end of the elongate support member to a base at a first location so that the elongate support member projects in cantilever fashion from the base;

directing the second free end of the elongate support member through the aperture in the article to place the article in a display state;

providing a lock member; and attaching the lock member to the second end of the elongate support member and abutting a part of the lock member to the shoulder at a location spaced from the first end of the elongate support member to cause the lock member to block movement of the article out of the display state past the second end of the elongate support member.

19. The method of displaying an article according to claim 18 including the step of removing the lock member from the elongate support member to remove the article that is in the display state.

20. The method of displaying an article according to claim 18 including the step of separating the first end of the elongate support member from the base and attaching the first end of the elongate support member to the base at a second location.

* * * * *